US010330317B2

(12) United States Patent
Chow

(10) Patent No.: US 10,330,317 B2
(45) Date of Patent: Jun. 25, 2019

(54) APPARATUS FOR EXTINGUISHING A WICK FLAME OF A CANDLE DISPOSED IN A CANDLE CONTAINER AND RELATED METHODS

(71) Applicant: Doris King Chow, Upper Marlboro, MD (US)

(72) Inventor: Doris King Chow, Upper Marlboro, MD (US)

( * ) Notice: Subject to any disclaimer, the term of this patent is extended or adjusted under 35 U.S.C. 154(b) by 0 days.

(21) Appl. No.: 15/802,382

(22) Filed: Nov. 2, 2017

(65) Prior Publication Data

US 2018/0106478 A1 Apr. 19, 2018

Related U.S. Application Data

(63) Continuation-in-part of application No. 15/297,041, filed on Oct. 18, 2016, now abandoned.

(51) Int. Cl.

| | |
|---|---|
| ***F23N 5/22*** | (2006.01) |
| ***F23Q 25/00*** | (2006.01) |
| ***F23N 5/24*** | (2006.01) |
| ***F23D 3/18*** | (2006.01) |

(52) U.S. Cl.

CPC ..... *F23N 5/22* (2013.01); *F23D 3/18* (2013.01); *F23N 5/245* (2013.01); *F23Q 25/00* (2013.01)

(58) Field of Classification Search

CPC ..... F23Q 25/00

USPC .... 431/33, 144, 146, 34; 220/813, 812, 816, 220/817, 818, 819, 811, 826, 822, 820, 220/212

See application file for complete search history.

(56) References Cited

U.S. PATENT DOCUMENTS

| | | | | |
|---|---|---|---|---|
| 1,210,256 | A * | 12/1916 | Aoyama | F23Q 25/00 431/34 |
| 7,186,912 | B2 * | 3/2007 | Guan | G02B 6/4201 174/17 R |
| 8,469,701 | B2 | 6/2013 | Quinn et al. | |
| 2003/0134242 | A1 * | 7/2003 | Hart | F21V 35/00 431/33 |
| 2007/0031769 | A1 | 2/2007 | Burton et al. | |
| 2007/0128561 | A1 | 6/2007 | Hart | |
| 2007/0184395 | A1 | 8/2007 | Taylor | |
| 2009/0194551 | A1 * | 8/2009 | Bussiere | B65D 43/14 220/812 |
| 2010/0001014 | A1 | 1/2010 | Tabone | |

(Continued)

*Primary Examiner* — Avinash A Savani
*Assistant Examiner* — Rabeeul I Zuberi
(74) *Attorney, Agent, or Firm* — Pillsbury Winthrop Shaw Pittman LLP

(57) ABSTRACT

This disclosure describes an apparatus for extinguishing a flame of a candle in a candle container. The apparatus includes a base and a retractable lid positioned around an opening of the container. The lid may include two halves that are moved between open and closed positions. Control arms cause the retractable lid to close. A mechanical timer controls opening of the lid and a countdown such that, after expiration of a predetermined time period, the lid is closed. A manual over-ride causes the lid to close manually, independent of the timer. Impact sensors are configured to cause the control arms to release and close the lid responsive to a detection of impact or disturbance. The sensors may be positioned around the base such that when an impact is sensed by one sensor, each of the sensors is activated to release the lid and enclose the opening to extinguish the flame.

12 Claims, 10 Drawing Sheets

(56) References Cited

U.S. PATENT DOCUMENTS

| | | | | |
|---|---|---|---|---|
| 2011/0084456 | A1* | 4/2011 | Ohmi | F16J 15/0887<br>277/647 |
| 2012/0122041 | A1* | 5/2012 | Billy | F21V 35/00<br>431/2 |
| 2013/0302740 | A1 | 11/2013 | Belczak | |
| 2014/0134552 | A1 | 5/2014 | Trevino et al. | |

* cited by examiner

APPARATUS FOR EXTINGUISHING A WICK FLAME OF A CANDLE DISPOSED IN A CANDLE CONTAINER AND RELATED METHODS

CROSS REFERENCE TO RELATED APPLICATION

This disclosure is a continuation-in-part of U.S. Ser. No. 15/297,041, filed Oct. 18, 2016, which is hereby incorporated by reference in its entirety.

FIELD OF THE DISCLOSURE

This disclosure relates to apparatus for extinguishing a wick flame of a candle disposed in a candle container and related methods.

BACKGROUND

Candles are aesthetic accessories that may be used in homes and other places as a decoration to provide a special ambiance and soft glow. However, unlike other decorations, lit candles may present a flame and fire hazard to their environment. The dangers from lit candles may be eliminated with their extinguishment. Candles may include different types and associated aesthetics. A jar candle may be a type of candle which includes a wax candle housed in a glass jar.

SUMMARY

Current solutions for automatically extinguishing lit candles may include digital timers and electronic sensors coupled with actuators configured to cause a shutter or a lid to dose. Such devices may be susceptible to electronic failures and may require period maintenance (e.g., changing batteries, replacing worn out electronic components). Furthermore, conventional candle extinguishers may include a timing device that may be either AC or battery powered. As such, the candle-timer may be either permanently tethered to a wall socket or may run the risk of having the batteries drain. For example, drained batteries and/or a power outage from a breaker overload and/or from a storm (in the case of the candle-timer being powered by AC electricity) may result in safety features of the candle-timer to cease operation. Other solutions may include devices that spray non-flammable fluid to extinguish the candle. Accordingly, one or more aspects of the present disclosure relate to controlling how long a wick-based candle can remain lit thereby increasing convenience and safety.

One aspect of the disclosure relates to an apparatus configured for extinguishing a wick flame of a candle disposed in a candle container. The apparatus may include a base configured to be positioned adjacent to an opening of the candle container that provides access to a wick and the flame of the candle. The apparatus may include a flexible, retractable lid connected to the base and configured to move between (a) an open position wherein the wick and flame are accessible via the opening and (b) a closed position wherein the lid encloses the opening of the candle container to thereby extinguish the wick flame. The retractable lid may include a first half and a second half. Control arms are positioned around the opening of the candle container and configured to keep the halves of the retractable lid in the open position. The one or more control arms may be configured to cause the retractable lid to close responsive to the one or more control arms being released. The halves include ends that are configured to move in a generally upward direction relative to the opening and towards each other to meet in the closed position. The apparatus may include a mechanical timer. The mechanical timer may be configured to control a countdown such that, responsive to an expiration of a predetermined time period, the control arms are caused to be released thereby causing the retractable lid to move from its open position to its closed position. The apparatus may include a manual over-ride configured to cause the control arms to be released independent of the mechanical timer. The apparatus may include a plurality of sensors provided on the base. The plurality of sensors may be spaced around the opening and configured to cause the retractable lid to move from its open position to its closed position responsive to a detection of impact or disturbance.

Another aspect of this disclosure relates to a method for extinguishing a wick flame of a candle disposed in a candle container using the apparatus described above. The method includes: setting the mechanical timer for a predetermined amount of time; providing the first half and the second half of the retractable lid in the open position; lighting a wick of the candle container to produce a wick flame; detecting, using at least one of the plurality of sensors, an impact to the candle container; and causing the control arms to move the first half and second half from the open position to the closed position. The movement of the first half and second half includes moving ends of the halves in a generally upward direction relative to the opening and towards each other to meet in the closed position.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
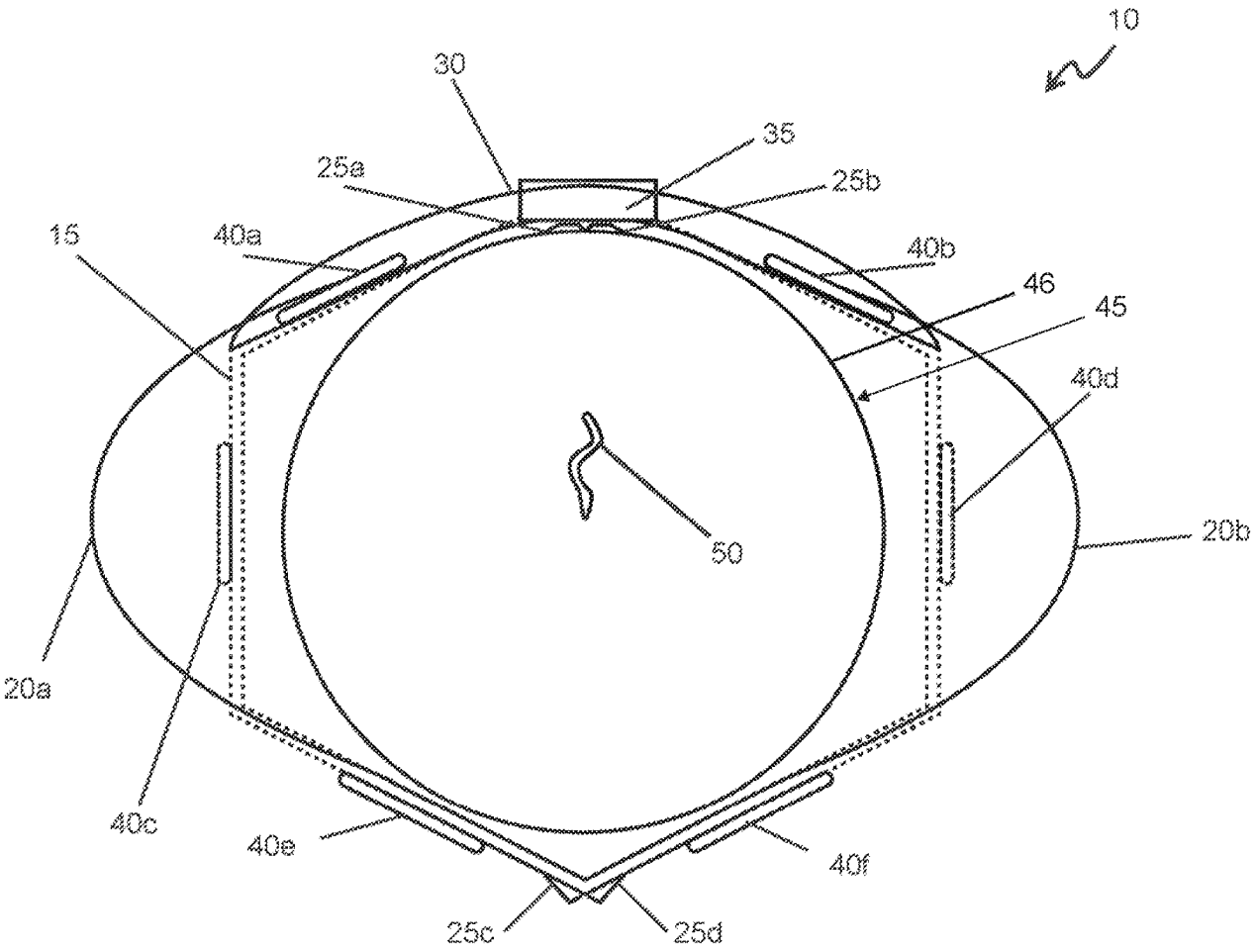
FIG. 1 illustrates a top view of an exemplary implementation of an apparatus configured for extinguishing a wick flame of a candle disposed in a candle container, in accordance with one or more implementations.

FIG. 1 illustrates a top view of an exemplary implementation of an apparatus 10 configured for extinguishing a wick flame of a candle disposed in a candle container 45 (e.g., jar candles, scented candles in jars), in accordance with one or more implementations. In some implementations, apparatus 10 may include a base 15, a retractable lid 20, one or more control arms 25*a*, 25*b*, 25*c*, and 25*d*, a mechanical timer 30, a manual override 35, and one or more sensors 40*a*, 40*b*, 40*c*, 40*d*, 40*e*, and 40*f*, and/or other components. The base 15 may be positioned adjacent to an opening 46 of the candle container 45 that provides access to a wick and flame of the candle therein. In some implementations, base 15 may be configured to be attached, connected, or coupled to the candle container. For example, the base 15 may be positioned such that it is around and surrounds the opening 46 of the candle container, in accordance with an embodiment. In another embodiment, the base 15 may be positioned adjacent to or on top of the opening 46. In yet another embodiment, the base 15 is secured to the candle container 45 just below its opening 46 such that the retractable lid 20 is positioned around or adjacent to the opening 46.

In some implementations, base 15 may include a retention device. In some implementations, the retention device may be sized to fit one or more different candle containers and/or to hold, lock, and/or fit base 15 to one or more different candle containers. For example, the retention device may be sized to fit different candle openings within a given range similar to a worm clamp, e.g., such that a portion is adjustable and locked around a device. Other examples of retention devices that may be used or adapted for use with the base 15 are hose clamps with bolts, e.g., T-bolts, and/or keyed hose clamps, for example, that may be manually adjusted in width or diameter and locked using the bolt or key. In one embodiment, such as shown by retention device 14 in FIG. 6, the retention device may be provided on part of the base 15 (e.g., a bottom part or ring). Such a depiction is exemplary only, and thus the type of retention device is not intended to be limiting. A retention device may be used with either or both illustrated embodiments.

In some implementations, one or more edges of the base may be beveled and/or chamfered. In some implementations, the base and/or its edges may be configured to, responsive to the candle container being knocked over, prevent the candle container from rolling.

Figure 3:
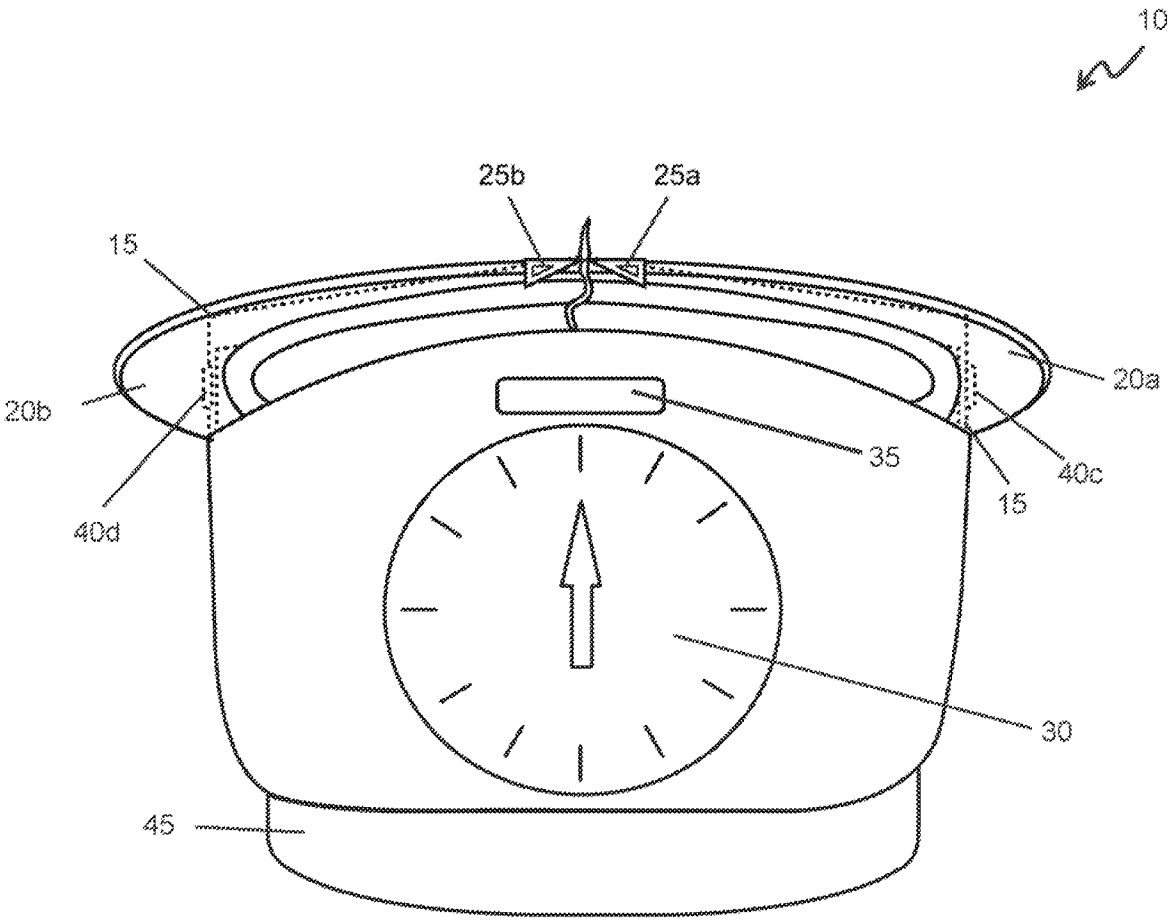
FIG. 3 illustrates a front view of an exemplary implementation of an apparatus configured for extinguishing a wick flame of a candle disposed in a candle container, in accordance with one or more implementations.
Figure 4:
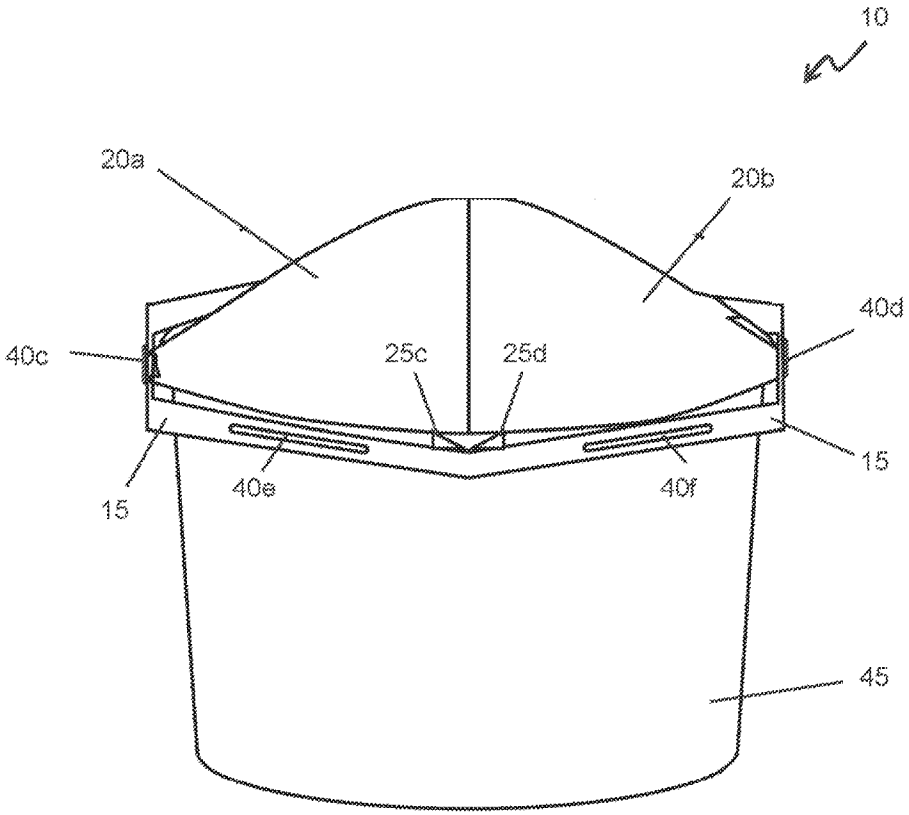
FIG. 4 illustrates a side view of an exemplary implementation of an apparatus configured for extinguishing a wick flame of a candle disposed in a candle container, in accordance with one or more implementations.
Figure 6:
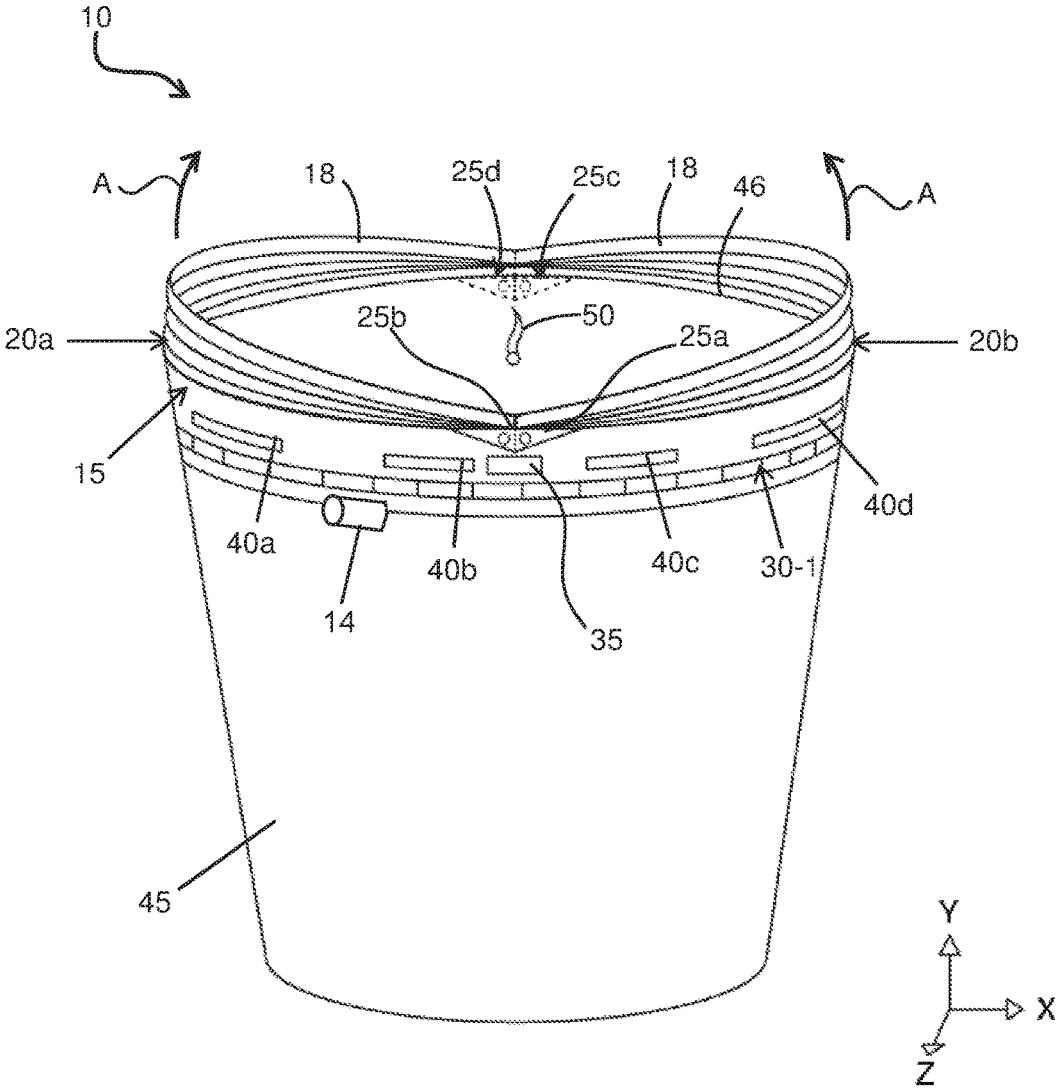
FIG. 6 illustrates an angled side view of an apparatus in a first, open position, configured for extinguishing a wick flame of a candle disposed in a candle container, in accordance with an embodiment herein.
Figure 7:
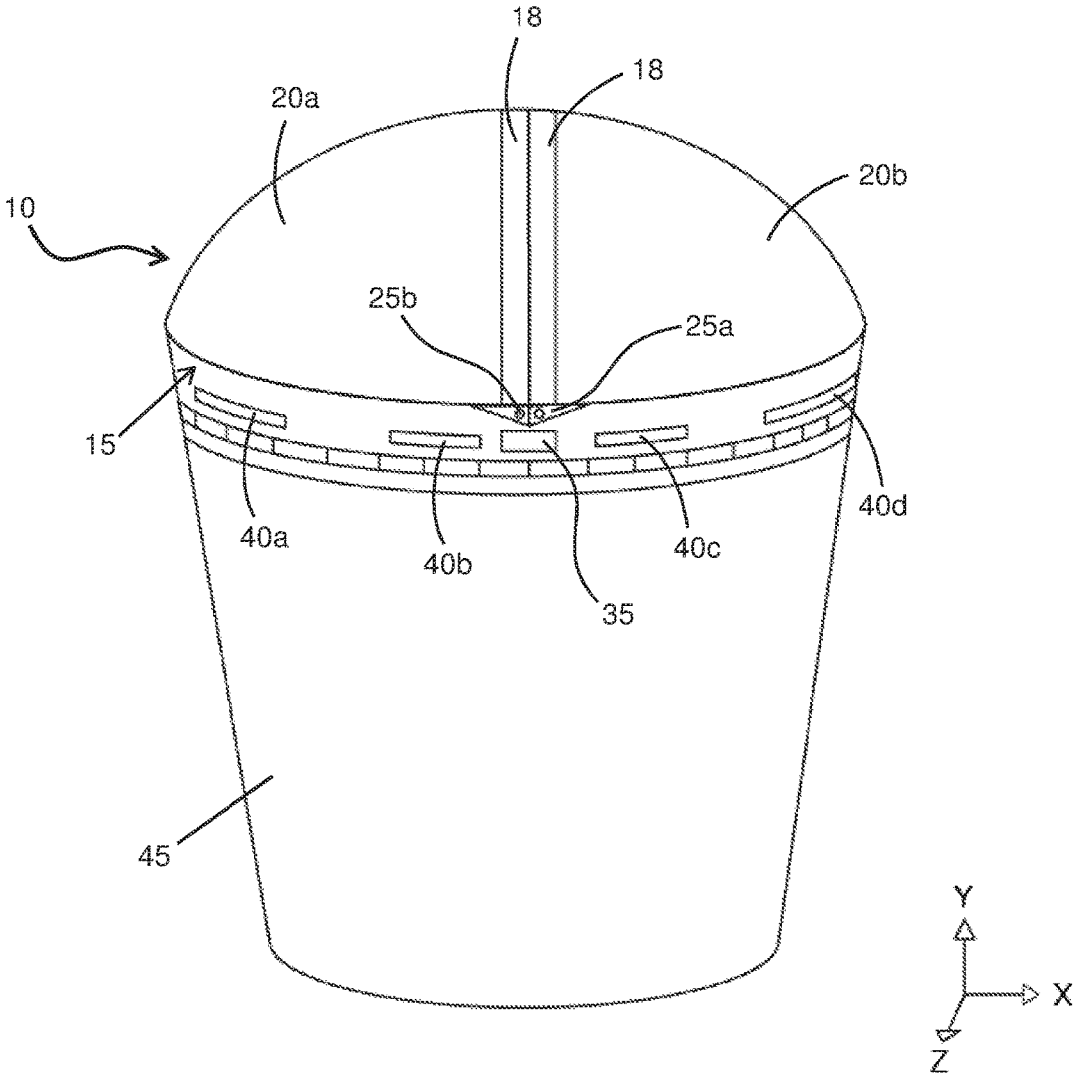
FIG. 7 illustrates an angled side view of the apparatus of FIG. 6 in a second, closed position for extinguishing the wick flame of the candle disposed in the candle container.

In some implementations, apparatus 10 may include retractable lid 20 connected to the base 15. The retractable lid 20 is configured to expand and enclose an opening 46 of the candle container 45 when the retractable lid is in a closed position (e.g., see FIGS. 4 and 7), and collapse and open for positioning adjacent to or around the opening when the retractable lid is in an open position (e.g., see FIGS. 3 and 6). In some implementations, retractable lid 20 may include a first half 20*a* and a second half 20*b*. In accordance with an embodiment, the halves 20*a* and 20*b* include ends that are configured to move in an generally upward direction relative to the opening 46 (e.g., as shown by arrows A in FIGS. 3 and 6) and towards each other to meet in the closed position. In some implementations, first half 20*a* and second half 20*b* may be configured to form a seal when first half 20*a* and second half 20*b* are in the closed position (e.g., as illustrated in FIG. 4 and described below). In some implementations, first half 20*a* and second half 20*b* may form individual halves of a sem ispherical retractable lid. That is, when in the closed position, the halves 20*a*, 20*b* of the retractable lid 20 may form a dome or similar shape over the opening 46, such as shown in FIG. 4 or FIG. 7, for example.

In some implementations, first half 20*a* and second half 20*b* may be constructed from a fire-safe material. In some implementations, metals such as steel, brass, silver, alumina, and/or other metals may be used to construct the retractable lid. In some implementations, silicone and/or other non-flammable materials may be used to construct the retractable lid. In some implementations, retractable lid 20*a* and 20*b* may be constructed using one or more flexible materials such that first half 20*a* and second half 20*b* are stored on a first side and a second side of the candle container respectively. The first and second halves 20*a*, 20*b* may be configured to collapse accordion-style, e.g., such that portions are bent or folded and stacked on top of each other when collapsed and placed in an open position.

In some implementations, first half 20*a* and second half 20*b* may include a curved metal shaft (see, e.g., shaft 18 of FIG. 7) positioned at an end of each half 20*a* and 20*b* such that when the halves 20*a*, 20*b* are closed towards each other, the curved metal shafts meet in the closed position of the retractable lid 20. Each curved metal shaft may be of semi-circular configuration and positioned near, around, or on a side or lip of opening of the candle container 45 when the retractable lid 20 is in its open position, for example. In some implementations, the curved metal shaft may be compressed and retained under the one or more control arms 25*a*, 25*b*, 25*c*, 25*d*, and/or other control arms when retractable lid 20*a* and 20*b* is locked in an open position. The shafts may be attached at or near the control arms 25*a*, 25*b*, 25*c*, and 25*d*. In some implementations, the curved metal shaft may be encased in a fire safe material. In some embodiments, the curved metal shafts may be embedded within fire safe material of the lid portions 20*a* and 20*b*.

In some implementations, the fire safe material for the retractable lid 20 and/or its parts may include silicone, coated fiberglass, carbonized acrylic felt (PANOx), and/or other fire safe material capable of withstanding the heat from the open flame for several seconds without reaching their flashpoint temperature. The fire safe material used for the halves 20*a*, 20*b* may be configured to withstand temperatures up to 700 degrees Fahrenheit, in accordance with one embodiment.

Figure 2:
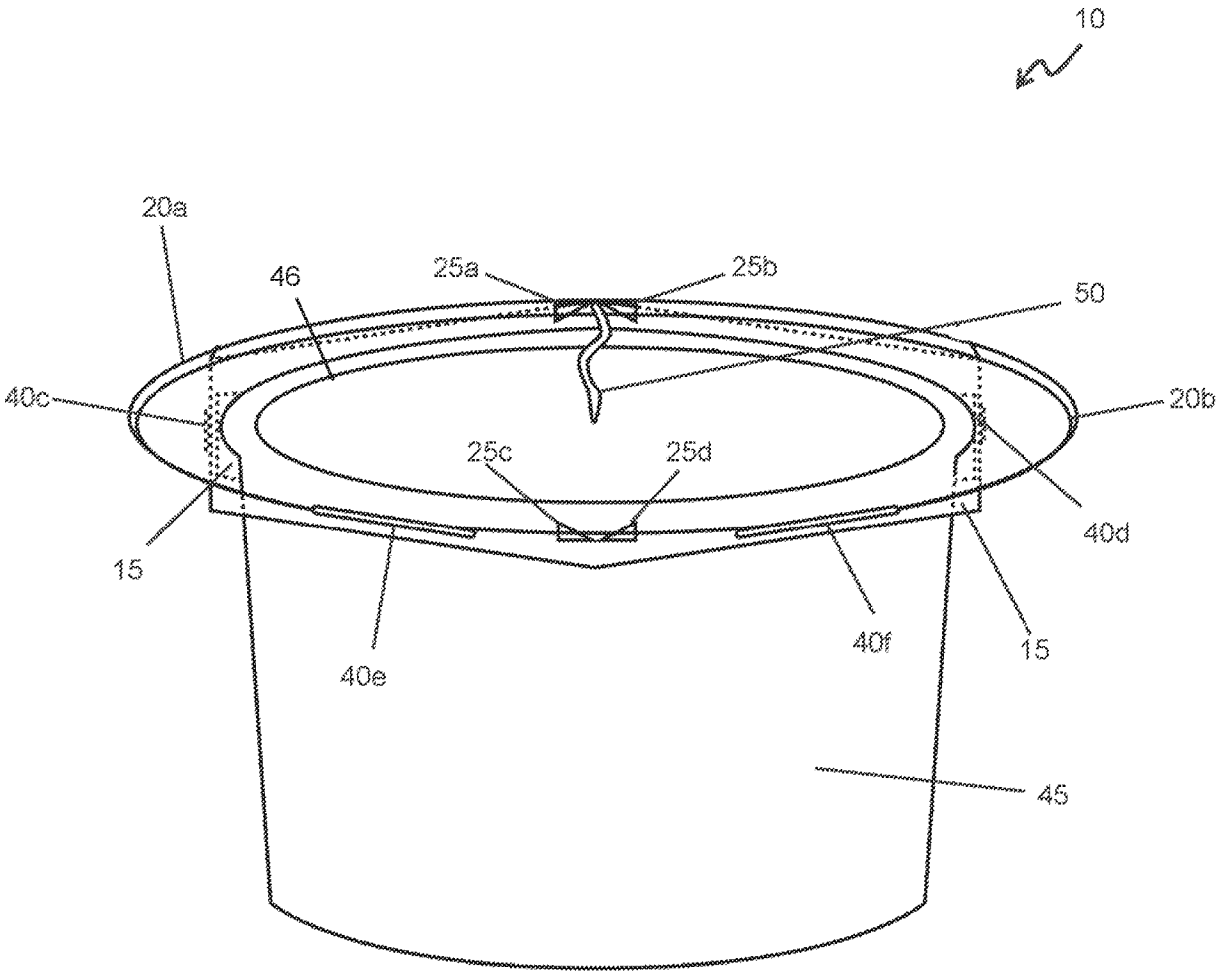
FIG. 2 illustrates a side view of an exemplary implementation of an apparatus configured for extinguishing a wick flame of a candle disposed in a candle container, in accordance with one or more implementations.

By way of a non-limiting example, FIG. 2 illustrates a side view of an exemplary implementation of an apparatus 10 configured for extinguishing a wick flame of a candle disposed in a candle container, in accordance with one or more implementations. As depicted in FIG. 2, first half 20*a* and second half 20*b* are stored on or adjacent to a first side and a second side of candle container 45 respectively.

In some implementations, retractable lid 20*a* and 20*b* may be spring loaded, e.g., via tension springs. For example, the lid may have tension springs provided on either side of first half 20*a* and second half 20*b* near the control arms 25*a*-25*b*. When the lid 20 is opened, the retractable lid is spring loaded via tension being added to the tensions springs (e.g., through rotation of those springs) when the halves 20*a* and 20*b* of the retractable lid 20 are moved to the open position and kept open by the control arms 25*a*-25*d*. This added/loaded spring tension assists the control arms 25*a*-25*d* in moving the first and second halves 20*a* and 20*b* to the closed position when they are released. In some implementations, responsive to the retractable lid 20*a* and 20*b* being in a closed position, the wick 50 flame may be deprived of oxygen such that the candle is extinguished.

In some implementations, first half 20*a* and second half 20*b* may be caused to close by the one or more control arms 25*a*, 25*b*, 25*c*, 25*d*, and/or other control arms without disrupting stability of the entire apparatus, knocking the candle over, and/or creating a fire hazard. In some implementations, due to the use of flexible materials in constructing first half 20*a* and second half 20*b*, the retractable lid halves may be stored on either side of the candle container without negatively affecting a center of gravity of apparatus 10. As such first half 20*a* and second half 20*b* may be closed rapidly without causing an imbalance to the candle container.

In some implementations, the retractable lid may be configured such that while the candle remains lit, first half 20*a* and/or second half 20*b* do not restrict the airflow to and from the candle. Unrestricted air flow may allow scented candles to emit a fragrant odor for a given area. In some implementations, first half 20*a* and/or second half 20*b* may be configured to remain in the open position while the candle remains lit. First half 20*a* and second half 20*b* remaining in the open position while the candle is lit may prevent continual exposure to the heat source and may reduce degradation of the retractable lid due to the flame.

Figure 9:
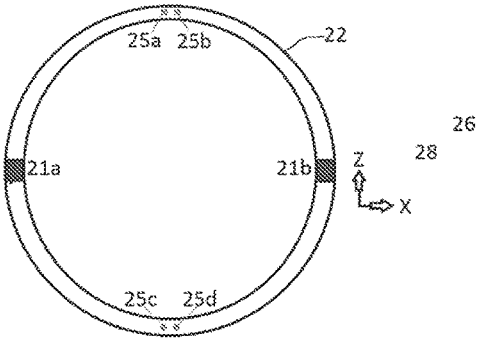
FIGS. 9 and 10 illustrate an overhead or top view and a side view, respectively, of a first or top part of the base of FIG. 8, including control arms and retractable lid, in accordance with an embodiment herein.

Returning to FIG. 1, apparatus 10 may include one or more control arms 25*a*, 25*b*, 25*c*, 25*d*, and/or other control arms. In some implementations, control arms 25*a*, 25*b*, 25*c*, 25*d*, and/or other control arms may be configured to keep retractable lid 20*a* and 20*b* in an open position (e.g., as illustrated in FIG. 3 and described below). Control arms are positioning around the opening 46 of the candle container 45. In an embodiment, control arms may be provided on both sides of the candle container 45, such as seen in FIG. 1 and FIG. 9. In some implementations, control arms 25*a*, 25*b*, 25*c*, 25*d*, and/or other control arms may be configured to cause retractable lid 20*a* and 20*b* to close responsive to one or more control arms 25*a*, 25*b*, 25*c*, 25*d*, and/or other control arms being released. In some implementations, one or more control arms 25*a*, 25*b*, 25*c*, 25*d*, and/or other control arms may be disposed to provide a connecting bridge between retractable lid 20*a* and 20*b* and the mechanical timer 30 (described below). In some implementations, one or more control arms 25*a*, 25*b*, 25*c*, 25*d*, and/or other control arms may be held in place for a period of time predetermined by setting mechanical timer 30 such that retractable lid is 20*a* and 20*b* kept open. In some implementations, one or more control arms 25*a*, 25*b*, 25*c*, 25*d*, and/or other control arms may be constructed of metal and mounted to base 15 (e.g., proximate to where first half 20*a* and second half 20*b* are joined). In some implementations, one or more control arms 25*a*, 25*b*, 25*c*, 25*d*, and/or other control arms may be configured such that one or more control arms 25*a*, 25*b*, 25*c*, 25*d*, and/or other control arms latch over respective one of first half 20*a* or second half 20*b*). In some implementations, responsive to expiration of a predetermined time period, activation of manual over-ride, and/or detection of an impact or disturbance, one or more control arms 25*a*, 25*b*, 25*c*, 25*d*, and/or other control arms may release first half 20*a* and second half 20*b* such that a pressure provided by springs 36 causes first half 20*a* and second half 20*b* to close.

In one embodiment, control arms 25*a*-25*d* may include an arm portion that extends along at least a part of each lid half 20*a* and 20*b*. For example, the curved metal shafts 18 (described later below) may be a part of the control arms. In an embodiment, the control arms may include a portion that extends from each point 25*a*, 25*b*, 25*c*, and 25*d* along an edge of each half 20*a* and 20*b* of the lid 20. Control arms 25*a*-25*d* may include pivot points or shafts and a lock/release mechanism associated therewith. In some embodiments, the tension springs 36 are associated with the control arms 25*a*-25*d* at its points or shafts. For example, each of the control arms may include an arm portion that may be shaped as one half of a half 20*a* or 20*b* of lid 20, or a ¼ of a circle, or less, in accordance with an embodiment. The arm portion may be positioned along an edge of a lid portion. The arm portion of the control arms may further include a small projection shaft that is connected at one of the connection points 34 of the control arm 25*a*, 25*b*, 25*c*, 25*d* and receives a tension spring 36 thereon. Generally, however, it should be noted that the mechanisms for forming the control arms 25*a*-25*d* may vary so as long as it may be configured to secure the mechanical parts, e.g., lid portions 20*a* and 20*b*, in a closed position and keep the lid in an open position (e.g., when the timer is activated)

By way of a non-limiting example, FIG. 3 illustrates a front view of an exemplary implementation of an apparatus 10 configured for extinguishing a wick flame of a candle disposed in a candle container 45 in accordance with one or more implementations. As illustrated in FIG. 3, control arms 25*a*, 25*b*, and 25*c*, 25*d* (not shown in FIG. 3) may keep first half 20*a* and second half 20*b* of the retractable lid in an open position.

In one embodiment, control arms 25*a*, 25*b* are provided on a first side of the candle container and control arms 25*c*, 25*d* are provided on an opposite side of the container. In an embodiment, each of the control arms are configured to make the first and second halves 20*a*, 20*b* hinged or pivotable between the open position and the closed position. Each of the halves may include two pivoting points on opposite sides of the opening, for example.

Returning to FIG. 1, apparatus 10 may include a mechanical timer 30. Mechanical timer 30 may be configured to control a countdown such that, responsive to an expiration of a predetermined time period, the one or more control arms are caused to be released, to then close the lid. In some implementations, mechanical timer 30 may be configured such that responsive to the predetermined time period being set on the mechanical timer 30, retractable lid 20*a* and 20*b* is configured to open. That is, the activation of the timer 30 may be configured to allow the halves 20*a*, 20*b* to move from a (default) closed position to an open position. For example, the control arms 25*a*-25*d* may be configured to unlock and allow the lid halves 20*a*, 20*b* to pivot generally downwardly towards the opening 46 of the candle holder. As illustrated in FIG. 3 and FIG. 6, for example, responsive to a predetermined time period being set on mechanical timer 30, the one or more control arms 25*a*, 25*b*, 25*c*, 25*d*, and/or other control arms may be configured to cause retractable lid 20*a* and 20*b* to remain in an open position, e.g., via a locking mechanism. In some implementations, responsive to the predetermined time period being set on mechanical timer 30, the candle may be lit, e.g., after the halves 20*a* and 20*b* are provided (and maintained) in an open position.

The setting of the mechanical timer 30 may include rotating or turning a portion of the timer or its body. For example, as shown in FIG. 3, at least a knob (e.g., illustrated in the form of an arrow) may be turned or rotated to set a time period for the countdown.

The embodiment described with reference to FIGS. 6-17 illustrates an alternate implementation of a mechanical timer 30 associated with base 15 of the apparatus 10, in the form of timer ring 30-1, in accordance with this disclosure. The timer ring 30-1 may be configured for rotation around the base 15 and/or container 45, e.g., in a clockwise direction, to set a predetermined time period, in accordance with an embodiment herein.

Returning to FIG. 1, apparatus 10 may include a manual over-ride 35. In some implementations, manual over-ride 35 may be configured to cause the one or more control arms 25*a*, 25*b*, 25*c*, 25*d*, and/or other control arms to be released independent of mechanical timer 30. In some implementations, responsive to manual over-ride 35 being triggered, the one or more control arms 25*a*, 25*b*, 25*c*, 25*d*, and/or other control arms may be released. Responsive to the one or more control arms 25*a*, 25*b*, 25*c*, 25*d*, and/or other control arms being released, the retractable lid 20*a* and 20*b* may be caused to close extinguishing the flame independent of mechanical timer 30. As illustrated in FIG. 3, manual over-ride 35 may be disposed on a surface of the candle container such that it is accessible to a user. The manual over-ride 35 may be disposed above mechanical timer 30, below mechanical timer 30, proximate to a side of mechanical timer 30, and/or any other position.

The embodiment described with reference to FIGS. 6-17 illustrates an alternate implementation of a manual override 35 associated with base 15 of apparatus 10, in accordance with this disclosure. For example, in accordance with an embodiment, the manual override 35 is provided in the form of a button on the base 15 and associated with timer ring 30-1 as well as control arms 25*a*-25*d*.

Returning to FIG. 1, apparatus 10 may include one or more sensors 40*a* . . . 40*n* (n being a definite number). In accordance with an embodiment, multiple sensors are provided with apparatus 10. In the exemplary illustrated embodiment, sensors 40*a*, 40*b*, 40*c*, 40*d*, 40*e*, 40*f* are shown. However, the illustrations are not intended to be limiting and fewer sensors may be provided with apparatus 10. In some implementations, one or more sensors 40*a*, 40*b*, 40*c*, 40*d*, 40*e*, 40*f*, and/or other sensors may be configured to cause one or more control arms 25*a*, 25*b*, 25*c*, 25*d*, and/or other control arms to be released responsive to a detection of impact. In some implementations, one or more sensors 40*a*, 40*b*, 40*c*, 40*d*, 40*e*, 40*f* may cause one or more control arms 25*a*, 25*b*, 25*c*, 25*d* to be released responsive to the candle container being tipped and/or struck by a force. In some implementations, one or more sensors 40*a*, 40*b*, 40*c*, 40*d*, 40*e*, 40*f*, and/or other sensors may include one or more of a hair trigger, spring-loaded trigger, and/or other mechanical triggers and/or sensors.

By way of a non-limiting example, FIG. 4 illustrates a side view of an exemplary implementation of an apparatus 10 configured for extinguishing a wick flame of a candle disposed in a candle container, in accordance with one or more implementations. As depicted in FIG. 4, sensors 40*c*, 40*d*, 40*e*, 40*f*, and sensors 40*a*, 40*b* (not shown) may be configured to cause one or more control arms 25*a*, 25*b*, 25*c*, 25*d* to be released responsive to a detection of an impact. Furthermore, as shown in FIG. 4, one or more control arms 25*a*, 25*b*, 25*c*, 25*d* may be configured to cause the retractable lid halves 20*a* and 20*b* to close responsive to one or more control arms 25*a*, 25*b*, 25*c*, 25*d* being released. Responsive to first half 20*a* and second half 20*b* being in the closed position, the wick flame may be deprived of oxygen and the candle may be extinguished.

FIGS. 6-17 illustrate another exemplary embodiment of apparatus 10 that includes sensors such as sensors 40*a* . . . 40*n*, control arms 25*a*-25*d*, a mechanical timer 30, and a manual override 35. For purposes of clarity and brevity, like elements and components throughout the Figures are labeled with same designations and numbering as discussed with reference to FIGS. 1-5. Thus, although not discussed entirely in detail here below, one of ordinary skill in the art should understand that various features associated with the apparatus 10 as shown in and described with reference to FIGS. 1-5 may be similar to those features previously discussed. Additionally, it should be understood that the features shown in each of the individual figures is not meant to be limited solely to the illustrated embodiments. That is, the features described throughout this disclosure may be interchanged and/or used with other embodiments than those they are shown and/or described with reference to.

As previously described, apparatus 10 as shown in FIGS. 6-7 may include base 15 and retractable lid 20 configured to expand and enclose an opening of the candle container when the retractable lid is in a closed position (e.g., see FIG. 7), and collapse and open for positioning adjacent to or around the opening when the retractable lid is in an open position (e.g., see FIG. 6). A first half 20*a* and second half 20*b* may be stored on or adjacent to a first side and a second side of candle container 45, respectively. The halves 20*a* and 20*b* may include ends that are configured to move in a generally upward direction relative to the opening 46 and towards each other to meet in the closed position. In some implementations, first half 20*a* and second half 20*b* may form individual halves of a semispherical retractable lid. For example, when in the closed position, the halves 20*a*, 20*b* of the retractable lid 20 may form a dome or similar shape over the opening 46, such as shown in FIG. 7, for example.

The materials used to construct first half 20*a* and second half 20*b* have been discussed previously (e.g., a fire-safe material, metals, non-flammable materials. The first and second halves 20*a*, 20*b* may be configured to collapse accordion-style, e.g., such that portions are bent and stacked on top of each other.

In some implementations, first half 20*a* and second half 20*b* may each include a curved metal shaft 18 positioned at an end of each half 20*a* and 20*b* such that when the halves 20*a*, 20*b* are closed towards each other, the curved metal shafts 18 meet in the closed position of the retractable lid 20 (see FIG. 7). Each curved metal shaft 18 may be of semicircular configuration and positioned near, around, or on a side or lip of opening of the candle container 45 when the retractable lid 20 is in its open position, for example (see FIG. 6). The shafts may be attached at or near the control arms 25*a*, 25*b*, 25*c*, and 25*d*. In some implementations, the shafts 18 are part of the control arms 25*a*, 25*b*, 25*c*, and 25*d*. In some implementations, the curved metal shaft may be compressed and retained under the one or more control arms 25*a*, 25*b*, 25*c*, 25*d*, and/or other control arms when retractable lid 20*a* and 20*b* is locked in an open position. In one embodiment, the curved metal shafts 18 may lock with or be contained by a part of the base 15 when the lid 20 is locked in its open position. In some implementations, the curved metal shaft may be encased in a fire safe material. In some embodiments, the curved metal shafts may be embedded within fire safe material of the lid portions 20*a* and 20*b*.

Figure 8:
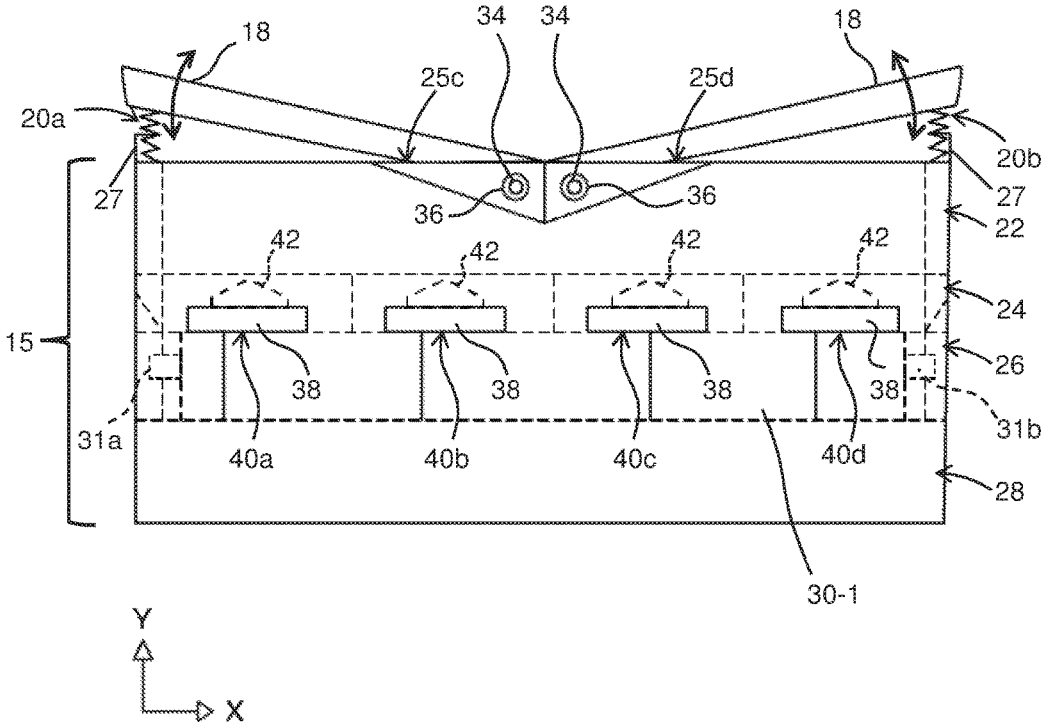
FIG. 8 illustrates a detailed view of parts of a base of the apparatus of FIG. 6, in accordance with embodiments herein.
Figure 10:
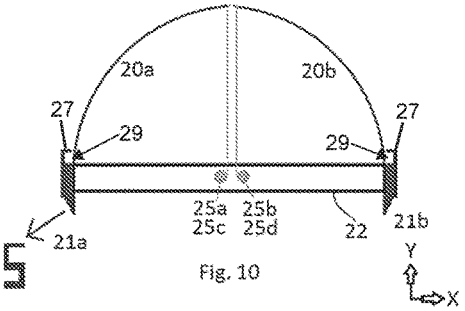

Movement of the halves 20*a* and 20*b* of the lid 20 into the open positon may cause the control arms 25*a*-25*d* to be spring-loaded via tensioning springs 36 provided about pivot points or arms 34 associated with the lid 20 and/or control arms 25*a*-25*d* (e.g., see FIG. 8). The control arms 25*a*-25*d* may define the pivot points for each torsion spring 36 whose default or at rest position is to close the lid 20. Accordingly, the first and second halves 20*a*, 20*b* may be pivotable or hinged between the open position and the closed position, and each of the halves 20*a* and 20*b* may include two pivoting points on opposite sides of the opening 46 when the apparatus 10 is positioned on the container 45 (see, e.g., FIGS. 9 and 10 showing points 25*a*, 25*c* associated with first half 20*a* of lid 20 and points 25*b*, 25*d* associated with second half 20*b* of lid 20). As represented in FIG. 8, for example, each spring 36 may be positioned around a point 34 or shaft (or as part of the curved metal shafts 18) (shown here, for example, as being associated with control arms 25*c* and 25*d*; arms 25*a*, 25*b* being understood to have similar construction), such that it is positioned externally around, on, or inside of the base (e.g., on first part 22, discussed in greater detail below). An arm portion of the control arms may extend along at least a part or an edge of each lid half 20*a* and 20*b* (see FIG. 10). For example, the curved metal shafts 18 may be a part of the control arms. The arm portion of the control arms may further include a small projection shaft that is connected at one of the connection points 34 of the control arm 25*a*, 25*b*, 25*c*, 25*d* and receives a tension spring 36 thereon. In use, after setting the timer 30, when the lid 20 is opened, the halves 20*a* and 20*b* may be forced or moved to the open position such that the retractable lid is spring loaded via tension being added to the tensions springs 36 (e.g., through rotation of those springs). The tensed springs 36 store potential energy therein as they are tensioned against their resting state. The lid 20 is kept open and temporarily, releasably locked by the control arms 25*a*-25*d*. This added/loaded spring tension assists the control arms 25*a*-25*d* in moving the first and second halves 20*a* and 20*b* to the closed position when they are released. Once unlocked, the spring tension is released and the springs 36 along with control arms 25*a*-25*d* assist in moving the lid 20 home to its closed position.

In accordance with an embodiment, the base 15 of the apparatus 10 includes multiple rings that assembled together and configured to be positioned around an opening, a mouth, or a lip of a candle container 45. In one embodiment, the base 15 is secured around or adjacent the opening 46 and/or body of the container 45 via a retention device 14, e.g., by adjusting and locking or clamping the retention device 14 such that the base 15 is secured thereto, near a top of the container 45 (as discussed previously). FIG. 8 illustrates a detailed example of base 15 that includes a first part 22, a second part 24, a third part 26, and a fourth part 28. In an embodiment, the parts 22-28 are configured to be stacked atop one another and attached to one another such that they form the base 15. The parts 22 may be separate and connected or attached together. One or more of the parts 22-28 may be integrally formed with another. In accordance with an embodiment, the shape of the base 15 and/or its parts 22-28 may correspond to a shape of the opening 46 of the candle container 45. In one embodiment, the parts 22-28 have a substantially circular or ring shape, such as depicted in FIGS. 9-16. As discussed in detail below, in an embodiment, at least one part (e.g., third part 26) may be configured to move or rotate relative to the other parts of the base 15 (e.g., about a center axis of the candle container 45).

FIGS. 9-16 illustrate each of the first part 22, second part 24, third part 26, and fourth part 28 in greater detail, the parts being shown in an exploded or disassembled view for explanatory purposes only.

FIG. 9 shows a top or overhead view of a first part 22 or ring with control arms 25*a*-25*d* (previously described) provided on opposite sides, e.g., in the depiction of FIG. 9, on a top and a bottom of the ring. In an embodiment, the first part 22 of the base 15 of apparatus 10 may be at least partially visible to a user when viewing the apparatus 10 from overhead. In one embodiment, the first part 22 is positioned to sit on or relative to the opening 46 of the candle container 45. The part 22 may include one part of each of the retention mechanisms on the apparatus 10 that are used to hold the halves 20*a*, 20*b* of the retractable lid 20 in an open position. The retention mechanisms may be configured to join together at two points around the container, for example, i.e., there may be two retention mechanisms. Use of two retention mechanisms is exemplary only and not intended to be limiting; one or more than two mechanisms may be used. In an embodiment, the retention mechanisms may include retention arms 21*a*, 21*b* that may be provided on opposite sides of the first part 22, e.g., in the depiction of FIG. 9, retention arm 21*a* is provided on a left side and a retention arm 21*b* is provided on a right side of the ring. The retention arms 21*a*, 21*b* may extend downwardly from a lower side of the first part 22 towards a bottom of the base 15, such as shown in FIG. 10. In accordance with embodiments herein, the retention arms 21*a*, 21*b* may be provided on, against, outside, inside, or below the ring of part 22. In an embodiment, each retention arm 21*a*, 21*b* may be substantially "S"-shaped, for example, with an upper part of each arm including a catch 27 and slot 29, and a lower part having a lower slot and arm. First part 22 further includes the first and second halves 20*a*, 20*b* attached to an upper side thereof, as shown in the side view of FIG. 10 (halves 20*a*, 20*b* not being shown in FIG. 9 solely for explanatory purposes).

Figure 16:
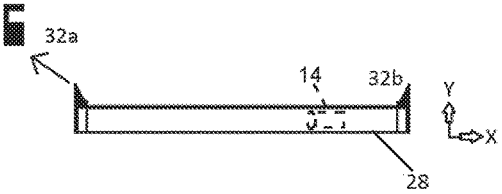

A lower part of the retention arms 21*a*, 21*b* of first part 22 may be configured to cooperate and interlock with a second part of the retention mechanisms, shown as retention clasps 32*a*, 32*b* (see FIGS. 15 and 16) provided on fourth part 28 or ring. The catches 27 of the retention arms 21*a*, 21*b* are mechanically positioned to latch the lid in the open position when interlocked with clasps 32*a*, 32*b*. The clasps 32*a*, 32*b* may be provided on opposite sides of the fourth part 28, e.g., in the depiction of FIG. 15, retention clasp 32*a* is provided on a left side and a retention clasps 32*b* is provided on a right side of the ring. The retention clasps 32*a*, 32*b* may extend upwardly from the fourth part 28 towards a top of the base 15, such as shown in FIG. 16. In an embodiment, each retention clasp 32*a*, 32*b* may be substantially hook- or "U"-shaped, for example, or shaped so to receive a lower portion of (the S-shape of) each retention arms 21*a*, 21*b*, respectively. Retention arms 21*a*, 21*b* are configured to selectively interlock with the clasps 32*a*, 32*b*, which are positioned below/at the bottom of the base (and may be pushed down to interconnect and snap or removably lock therewith). This provides for a more secure fit around the opening or mouth of the candle container 45, as well as a more reliable opening and closing mechanism for the retractable lid halves 20*a* and 20*b*. The shape and number of retention arms and retention clasps may correspond to and complement each other. In accordance with an embodiment, the retention arms 21*a*, 21*b* and clasps 32*a*, 32*b* are formed from complementary shapes, such that the arms and clasps may selectively and removably interlock with one another. In accordance with embodiments herein, when the mechanical timer is activated, the lid 20 is opened and the arms 21*a*, 21*b* and clasps 32*a*, 32*b* are configured to catch, interlock with and/or engage one another to assist or work together with the control arms 25*a*-25*d* for holding and keeping the lid 20 in its open position. In an embodiment, the arms 21*a*, 21*b* may be configured to drop into an interlocking engagement with clasps 32*a*, 32*b*. In one embodiment, a user may apply pressure to the first part 22 to push and interlock the arms 21*a*, 21*b* into the clasps 32*a*, 32*b*, such that the parts click together. In some embodiments herein, the arm and lower slot of lower portion of each retention arms 21*a* and 21*b* is configured to align or catch into upper slot and arm of clasps 32*a* and 32*b*, so hold the retention mechanisms in place.

In accordance with an embodiment, as shown with reference to FIG. 10 as well as FIG. 8, as the control arms 25*a*-25*d* (and thus lid halves) are lowered, at least a portion thereof is configured to catch underneath the catch 27, in slot 29, when the halves 20*a* and 20*b* are moved to the open position. This will simultaneously catch a lower slot of arms 21*a* and 21*b* into a slot or opening of clasps 32*a* and 32*b*, such that the clasps 32*a* and 32*b* hold the arms 21*a* and 21*b* in place and the control arms 25*a*-25*d* and lid open. In one embodiment, the curved metal shafts 18 are part of the control arms 25*a*-25*d* and may lock with or be contained by a part of the base 15, e.g., underneath catch 27 in slot 29, when the lid 20 is locked in its open position. The lid portions 20*a* and 20*b* may remain locked under the catches 27 while the retention mechanisms of the first and fourth parts 22 and 28 are connected, i.e., until a predetermined time is countdown. Closing of the lid 20 is further described below with reference to sensors 40*a* . . . 40*n* and timer ring 30-1, for example.

In one embodiment, such as shown in FIG. 6, the previously described retention device 14 may be provided on or associated with the fourth part 28 of the base 15 (e.g., a bottom part or ring). This allows at least the fourth part 28 to be adjusted and locked using the retention device 14, thereby locking the base 15 to the container 45. In an embodiment, the retention device 14 may be configured to adjusted each part 22-28 associated with the base 15.

Figure 11:
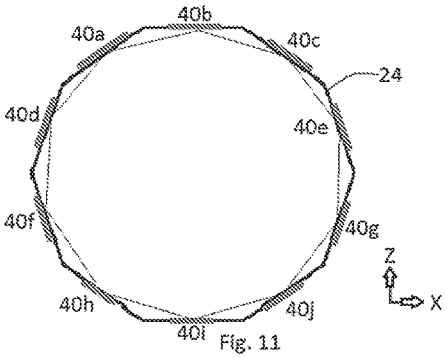
FIGS. 11 and 12 illustrate an overhead or top view and a side view, respectively, of a second part of the base of FIG. 8, including sensors thereon, in accordance with an embodiment herein.
Figure 12:
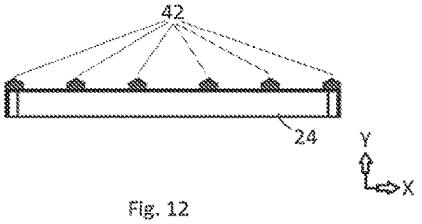

FIGS. 11-12 show an example of a second part 24 or ring of base 15 that is configured to be positioned below first part 22. The second part includes a number of sides with multiple impact sensors 40*a*, 40*b*, 40*c*, 40*d*, 40*e*, 40*f*, 40*g*, 40*h*, 40*i*, and 40*j* (or shock sensors) on an outer surface or outer side. The sensors 40*a*-40*j* are provided on an outer side of the base 15 such that impact or disturbance may be detected on the side of the candle container 45, such as when the container 45 is knocked or tipped over. The sensors 40*a*-40*j* may be spaced around the opening 46. In an embodiment, the sensors 40*a*-40*j* may be positioned just below opening 46 when the base 15 is attached to the container 45. In one embodiment, the sensors 40*a*-40*j* are relatively and equidistantly spaced around the base 15 and thus the opening 46 of the candle container 45 when the apparatus is attached thereto.

As previously described, sensors 40*a*-40*j* are configured to cause the retractable lid to move from its open position to its closed position response to detection of an impact or disturbance. In accordance with an embodiment, each sensor 40*a*-40*j* is an impact sensor, i.e., a sensor that is mechanically triggered based on impact or force applied thereto. In an embodiment, each impact sensor 40*a*-40*j* may be interconnected with and/or configured to trigger a next or adjacent sensor(s). For example, if any one of the impact sensors 40*a*-40*j* is triggered, a chain reaction is set off, triggering all of the sensors to be triggered or activated. In one embodiment, each sensor is configured to trigger sensors adjacent or next to it, e.g., on either side, in response to a trigger or detection of impact.

Figure 17:
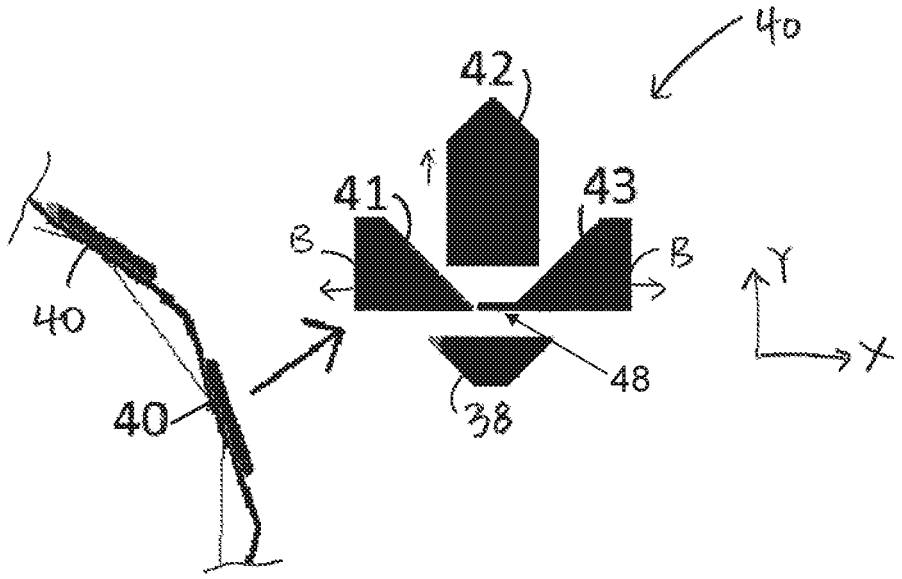
FIGS. 17 and 18 illustrate detailed, schematic views of parts of a sensor provided on the second part of FIGS. 11 and 12, in accordance with embodiments herein.
Figure 18:
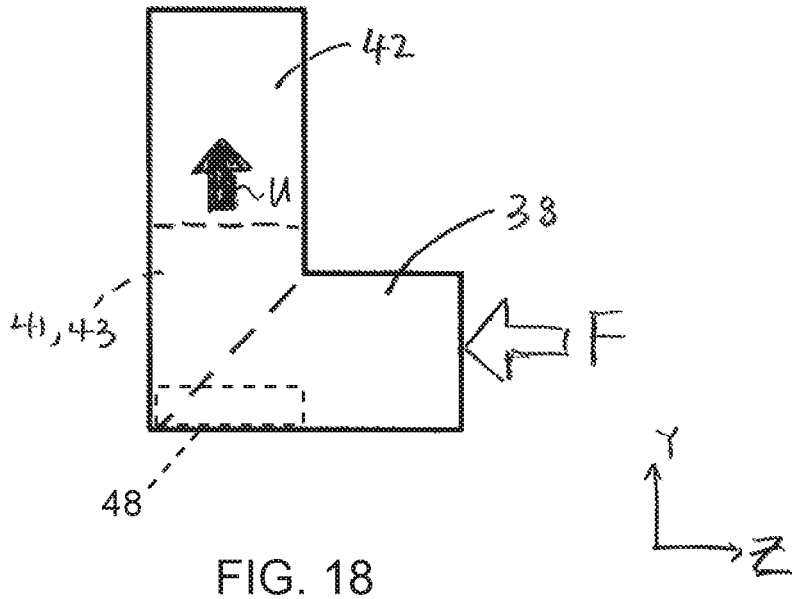

More specifically, FIG. 17 shows a detailed view, from the Z-direction, of a schematic example of parts of each impact sensor 40, in accordance with an embodiment. A trigger portion 38 of each impact sensor 40*a*-40*j* extends generally in a horizontal direction (e.g., in the Z-direction), relative or parallel to a bottom of the candle container 45. That is, when the base 15 is positioned on the candle container 45, the trigger portion 38 of each impact sensor 40*a*-40*j* extends outwardly away from the opening/mouth/lip and away from a center, or wick, of the candle. Ledges 41 and shelves 43 are interconnected to the trigger portion 38 and generally provided on either side of each sensor, extending perpendicularly relative to the trigger portion 38, e.g., in a lateral or horizontal direction therefrom. In an embodiment, each ledge 41 and shelf 43 may have a similarly shaped body (e.g., of polygonal, trapezoidal, triangular, etc.). Each shelf 43 further has a foot portion 48 that assists in triggering the associated sensors as well as triggering another sensor adjacent thereto. The foot portion 48 extends to a side or horizontally away from the body of the shelf 43 and towards the ledge 41. (Alternatively, it should be understood that each ledge 41 may instead include a foot portion that extends towards a shelf 43.) Each sensor 40*a*-40*j* also may include a push pin 42 that extends upwardly in a vertical direction (e.g., in the Y-direction). The sensors 40*a*-40*j* may generally extend towards first part 22 of the base 15. As schematically depicted in FIG. 18, force F or pressure that is applied against an outer surface of the trigger portion 38, i.e., in a direction towards the center or wick of the candle container, or in the Z-direction (such as when the container is knocked over), causes the trigger portion 38 to move (backwards towards the container in the Z-direction, or left, as depicted in FIG. 18). This movement of the trigger portion 38 causes or pushes the ledge 41 and shelf 43 to move horizontally or laterally relatively away from one other (see arrows B in FIG. 17) in the sensor by applying relatively equal pressure on push-pins 42 in the Y-direction and to bodies of the ledge 41 and 43 in the X-direction. However, the movement of the ledge 41 and shelve 43 will act upon adjacent ledges 41 and shelves 43 of the other sensors on either side or adjacent to that sensors, thus pushing an array of push-pins 42 upward. That is, each of the ledge 41 and shelf 43 interact with an adjacent ledge 41 and shelf 43 of another sensor to push up a push pin 42. For example, as ledge 41 is pushed in an X-direction away from its associated shelf 43 in its sensor 40, ledge 41 acts on an adjacent shelf 43 of an adjacent or next impact sensor in the series. In the absence of force on trigger portion 38 on the adjacent sensor, then, pressure from ledge 41 acts on the adjacent shelf 43 and moves its foot portion 48 towards and in contact with the ledge 41 of the adjacent sensor. This movement of the adjacent shelf 43 of adjacent sensor causes the push-pin 42 of that sensor to receive pressure (e.g., from an edge of the body of that shelf 43) and move vertically, in addition to moving, via its foot portion 48, the adjacent ledge 41 towards the next sensor. Accordingly, a chain reaction is caused to the series of sensors 40*a* . . . 40*n* by impacting a single sensor.

The movement of each of the push pins 42 in the vertical or upward direction causes pressure to the first part 22 or ring and in turn causes the retention arms 21*a*, 21*b* to release from the retention clasps 32*a*, 32*b*. In some embodiments, the arms 21*a*, 21*b* may be flexed or rocked along the Z-direction to disengage its lower portion from slots of the clasps 32*a*, 32*b*. In some embodiments, the arms 21*a*, 21*b*, may be pushed or moved laterally out of the slots of clasps 32*a*, 32*b*. In other embodiments, a portion of the arms 21*a*, 21*b* may be pivoted out of engagement with clasps 32*a*, 32*b*. In accordance with some embodiments, the clasps 32*a*, 32*b* may be moved, flexed, rocked, pivoted, etc. out of engagement with the arms 21*a*, 21*b*. In yet another embodiment, one of the parts 22 or 28 may be rotated slightly (e.g., one to two degrees) relative to the other to disengage the retention mechanisms. Accordingly, the movement or method of releasing the retention mechanisms (i.e., arms 21*a*, 21*b* and clasps 32*a*, 32*b*) is not intended to be limited. In an embodiment, upon release of the push pins 42 of the sensors 40*a*-40*j*, each is configured to apply a substantially uniform or consistent force upward to separate the retention arms 21*a*, 21*b* from the retention clasps 32*a*, 32*b*.

By way of this impact array, any disturbance to the candle container from any orientation will trigger the retention arms to release, thus allowing the lid portions 20*a* and 20*b* to release from the catch 27 and move towards one another to their closed position, extinguishing the flame in a safe and timely fashion.

Figure 13:
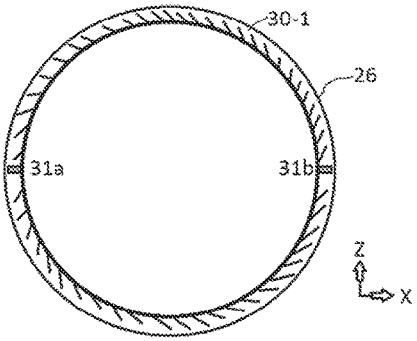
FIGS. 13 and 14 illustrate an overhead or top view and a side view, respectively, of a third part of the base of FIG. 8, including a mechanical timer, in accordance with an embodiment herein.
Figure 14:
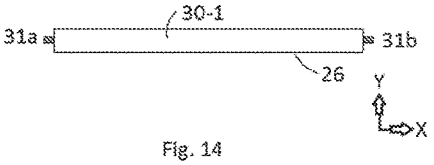
Figure 15:
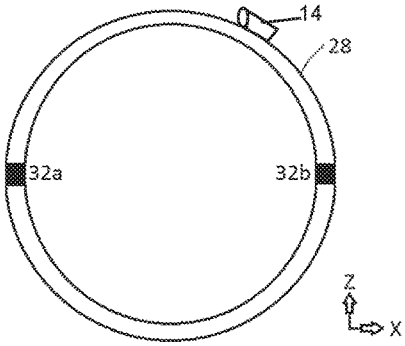
FIGS. 15 and 16 illustrate an overhead or top view and a side view, respectively, of a fourth or bottom part of the base of FIG. 8, in accordance with an embodiment herein.

FIGS. 13 and 14 shows a third part 26 in the form of a timer ring 30-1 or collar with release arms 31*a*, 31*b* positioned opposite to one another, i.e., on either side of the base 15. The timer ring 30-1 may be positioned below the first part 22 and relatively on top of fourth part 28, as shown in FIG. 8, for example. As depicted in FIG. 13, i.e., release arm 31*a* on a left side and release arm 31*b* on a right side of the ring, the release arms 31*a*, 31*b* are positioned at a zero position, i.e., preventing opening of the halves 20*a*, 20*b*. In accordance with embodiments herein, in order to move the retractable lid 20 and its halves 20*a*, 20*b* to an open position, the arms 31, 31*b* must be moved or rotated. The timer ring 30-1 may lock the lid 20 in its closed position until it is moved. In accordance with an embodiment, if the timer ring 30-1 is at zero, the retention arms 21*a*, 21*b* are mechanically prevented from latching the lid in the open position (as their lower portions are not interlocked with clasps 32*a*, 32*b*). Movement of the arms 31*a*, 31*b* allows the halves 20*a*, 20*b* to pivot or rotate to their open position, and arms 21*a*, 21*b* and clasps 32*a*, 32*b* may latch and engage. In accordance with an embodiment, the timer ring 30-1 is configured to be turned or rotated (e.g., in a clockwise direction about a center axis, as shown by arrow C in FIG. 13) to wind the timer device for a predetermined time period. Upon being wound, the release arms 31*a*, 31*b* are also moved or rotated away from the location of retention arms 21*a*, 21*b* (e.g., in the clockwise direction), thereby allowing the arms 21*a*, 21*b* to interlock with the clasps 32*a*, 32*b*. After being wound, the timer ring 30-1 rotates (e.g., in a counter clockwise direction), to control a countdown of the selected predetermined time period, around an opening 46 of the candle container 45, moving its release arms 31*a*, 31*b* therewith around the opening, towards their zero position.

As generally depicted in FIGS. 6 and 7, apparatus 10 may include a manual over-ride 35, as previously described, for releasing the control arms 25*a*, 25*b*, 25*c*, 25*d*, independently of the mechanical timer or timer ring 30-1. In some implementations, the manual over-ride 35 is associated with the timer ring 30-1. In some implementations, it is associated with any number of parts 22-28 of the base 15. The location and position of the manual over-ride 35 is not intended to be limiting. Upon triggering of the manual over-ride 35, for example, the retention mechanisms (e.g., arms 21*a*, 21*b* and clasps 32*a*, 32*b*) may be released, and the one or more control arms 25*a*, 25*b*, 25*c*, 25*d*, and/or other control arms may be released. Thus, the retractable lid 20*a* and 20*b* may be caused to close extinguishing the flame independent of timer ring 30-1.

For example, in accordance with an embodiment, the manual override 35 is provided in the form of a button on the base 15, e.g., associated with or on the timer ring 30-1, and associated with control arms 25*a*-25*d*.

If no impact occurs or is detected by one or more of the sensors 40*a*-40*j*, normal operation will proceed with the timer ring 30-1 completing its cycle down to zero, after which the release arms 31*a*, 31*b* attached to the timer ring 30-1 are positioned and configured to forcibly separate the retention arms 21*a*, 21*b* above from the retention clamps 32*a*, 32*b* below, releasing the halves/left cover 20*a* and the right cover 20*b*, allowing the spring-loaded control arms 25*a*-25*d* to close the covers towards each other, thereby limiting the amount of oxygen and extinguishing the candle flame.

Figure 5:
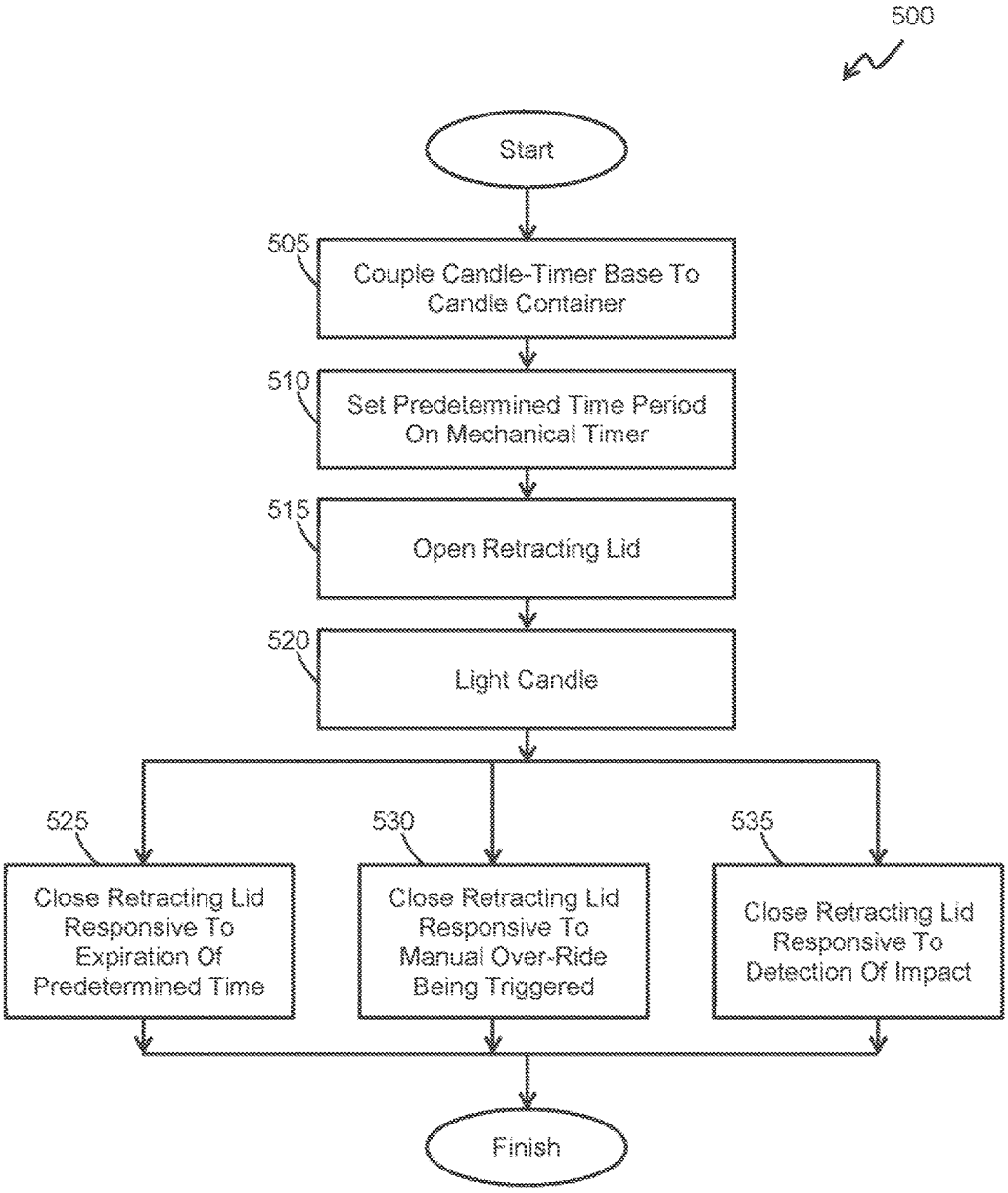
FIG. 5 illustrates a method for extinguishing a wick flame of a candle disposed in a candle container, in accordance with one or more implementations.

FIG. 5 illustrates a method 500 for extinguishing a wick flame of a candle disposed in a candle container. The operations of method 500 presented below are intended to be illustrative. In some implementations, method 500 may be accomplished with one or more additional operations not described, and/or without one or more of the operations discussed. Additionally, the order in which the operations of method 500 are illustrated in FIG. 5 and described below is not intended to be limiting.

At an operation 505, a candle-timer base is coupled to a candle container, such as container 45. The candle-timer base may be the same as or similar to base 15 (shown in FIG. 1 and described herein).

At an operation 510, a predetermined time period may be set on a mechanical timer. The mechanical timer may be the same as or similar to mechanical timer 30 shown in FIG. 1 and described herein or the timer ring 30-1 shown and described with reference to FIGS. 6-7 and 13-14.

At an operation 515, a retracting lid of the candle-timer is opened responsive to the predetermined time period being set on the mechanical timer 30. In some implementations, the retracting lid may include a first half and a second half. In some implementations, the first half and the second half may be stored on a first side and second side of a candle container respectively while in the open position. The first half and the second half may be the same or similar to first half 20*a* and second half 20*b* respectively (e.g., such as shown in FIG. 1 or FIG. 6, and described herein).

At an operation 520, responsive to the retractable lid being in the open position, a user may light the candle.

At an operation 525, the retractable lid is closed responsive to expiration of predetermined time of the mechanical timer. In some implementations, the retractable lid may be closed responsive to one or more control arms being released by the mechanical timer. The one or more control arms may be the same or similar to control arms 25*a*, 25*b*, 25*c*, and/or 25*d* (shown in FIG. 1 and described herein).

At an operation 530, the retractable lid is closed responsive to a manual over-ride being triggered. The manual over-ride may be the same or similar to manual over-ride 35 shown in FIG. 1 and described herein or the manual over-ride 35 shown and described with reference to FIGS. 6-7.

At an operation 535, the retractable lid is closed responsive to a detection of an impact. In some implementations, one or more sensors may be configured to cause the one or more control arms be released responsive to the candle container being tipped and/or struck by a force. The one or more sensors may be the same or similar to sensors 40*a*, 40*b*, 40*c*, 40*d*, 40*e*, and/or 40*f* shown in FIG. 1 and described herein or the sensors 40*a* . . . 40*n* shown and described with reference to FIGS. 6-7, 11-12, and 17-18.

Responsive to the retractable lid being closed in any of operations 525, 530, and/or 535, wick flame may be deprived of oxygen such that the candle is extinguished.

The embodiments of the herein disclosed apparatus 10 may be used with different types of candles and candle holders and is not limited in size or height with regards to the type(s) of candles & holders it may support.

Utilizing first half 20*a* and second half 20*b* attached to the container via control arms 25*a*-25*d* to form a lid and seal the candle container allows for certain safety elements to be integrated into the closing mechanism that cannot readily be achieved with prior art devices (e.g., such as those that include a single attachment point or single hinge point).

Affixing the disclosed apparatus 10 to the top of the candle/holder/enclosure ensures additional safety features should the candle enclosure be moved or knocked over intentionally or accidentally. For example, the herein described impact sensors may be interconnected with one another to cause a chain reaction of the sensors and close the lid. The sensors 40*a*-40*n* as provided on the apparatus do not require that the candle/candle container 45 be disturbed in a specific manner or orientation with regards to releasing the safety mechanism to function as intended.

In addition, embodiments of the herein disclosed apparatus 10 may be retrofit to any number of manufactured candle containers (e.g., jar candles) or candle containers configured to receive a candle therein (e.g., a container that receives a votive candle) using a retention mechanism. That is, the apparatus 10 may be positioned on upwardly facing openings or lips of any type and size of candle containers, and secured thereto. By affixing the apparatus to the top or opening of the candle/holder via an adjustable retention strap/clamp, such as by using base 15 and retention device 14, it can support candles of any height or size (i.e., diameter of the candle or candle holder) and provide a universal fit to such containers.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. An apparatus configured for extinguishing a wick flame of a candle disposed in a candle container, the apparatus comprising:

a base configured to be positioned adjacent to an opening of the candle container, the opening providing access to a wick and the flame of the candle;

a flexible, retractable lid, comprising a first half and a second half, connected to the base, each of the halves having a first end and a second end, the first end of each half being configured to pivot about fixed pivoting points provided on opposite sides of the opening and move between:

(a) an open position wherein the first half and the second half of the retractable lid are collapsed and the first ends of each half are stored on a first side and a second side of the candle container, respectively, such that the ends are positioned near, around, or on a side or a lip of the opening of the candle container, and the wick and the flame are accessible via the opening, and (b) a closed position wherein the first ends of the halves meet over the opening to cover the wick such that the halves are expanded and the retractable lid encloses the opening of the candle container to thereby extinguish the wick flame, and the second ends of each of the first half and the second half being fixed to the base of the apparatus in both the open position and the closed position of the first ends;

control arms positioned around the opening of the candle container and tension springs provided near the control arms that are associated with the retractable lid, the control arms being configured to:

keep the halves of the retractable lid in the open position; and cause the retractable lid to close responsive to the one or more control arms being released, the first ends of the halves being configured to pivot about the fixed pivoting points and thus move from the open position in a generally upward direction relative to the opening and towards each other to meet in the closed position such that the halves are configured to cover the wick, wherein, in the open position, the halves of the retractable lid are spring loaded via tension being added to the tension springs when the halves of the retractable lid are moved to the open position and kept open by the control arms, and wherein the tension assists in moving the first ends of the halves to the closed position when the control arms are released;

a mechanical timer configured to control a countdown such that, responsive to an expiration of a predetermined time period, the control arms are caused to be released thereby causing the retractable lid to move from its open position to its closed position;

a manual over-ride configured to cause the control arms to be released independent of the mechanical timer; and a plurality of sensors provided on the base, the plurality of sensors being spaced around the opening and configured to cause the retractable lid to move from its open position to its closed position responsive to a detection of impact.

2. The apparatus of claim 1, wherein the first half and the second half are constructed from a fire-safe material, and wherein the first half and the second half are configured to form a seal when the first half and the second half are in the closed position.

3. The apparatus of claim 1, wherein the control arms are disposed on opposing sides of the opening of the candle container.

4. The apparatus of claim 1, wherein the base comprises a retention device, wherein the retention device is configured to hold and/or lock the base to fit the opening of one or more different candle containers.

5. The apparatus of claim 1, wherein each of the first half and the second half further comprises a curved metal portion provided on the first ends thereof, the curved metal portion configured for movement with the first ends of the halves between the open position and the closed position, such that the curved metal portions are positioned near, around, or on, the side or the lip of the opening of the candle container in the open position and the curved metal portions are configured to meet over the wick and opening in the closed position.

6. The apparatus of claim 1, wherein each of the first half and the second half comprise two pivoting points on opposite sides of the opening.

7. The apparatus of claim 1, wherein each of the plurality of sensors includes a trigger mechanism, and wherein each sensor is configured to trigger sensors adjacent thereto in a chain reaction in response to the detection of impact by at least one of the plurality of sensors, in order to move the retractable lid to its closed position.

8. The apparatus of claim 1, wherein the plurality of sensors comprises one or both of a hair trigger or spring-loaded trigger.

9. A method for extinguishing a wick flame of a candle disposed in a candle container, the apparatus comprising: a base configured to be positioned adjacent to an opening of the candle container, the opening providing access to a wick and the flame of the candle; a flexible, retractable lid, comprising a first half and a second half, connected to the base, each of the halves having a first end and a second end, the first end of each half being configured to pivot about fixed pivoting points provided on opposite sides of the opening and move between: (a) an open position wherein the first half and the second half of the retractable lid are collapsed and the first ends of each half are stored on a first side and a second side of the candle container, respectively, such that the ends are positioned near, around, or on a side or a lip of the opening of the candle container, and the wick and the flame are accessible via the opening, and (b) a closed position wherein the first ends of the halves meet over the opening to cover the wick such that the halves are expanded and the retractable lid encloses the opening of the candle container to thereby extinguish the wick flame, and the second ends of each of the first half and the second half being fixed to the base of the apparatus in both the open position and the closed position of the first ends; control arms positioned around the opening of the candle container and tension springs provided near the control arms that are associated with the retractable lid, the control arms configured to: keep the halves of the retractable lid in the open position, and cause the retractable lid to close responsive to the one or more control arms being released; a mechanical timer configured to control a countdown such that, responsive to an expiration of a predetermined time period, the control arms are caused to be released thereby causing the retractable lid to move from its open position to its closed position; and a plurality of sensors provided on the base, the plurality of sensors being spaced around the opening and configured to cause the retractable lid to move from its open position to its closed position responsive to a detection of impact; wherein the method comprises:

setting the mechanical timer for a predetermined amount of time;

providing the first half and the second half of the retractable lid in the open position;

lighting a wick of the candle container to produce a wick flame;

detecting, using at least one of the plurality of sensors, an impact to the candle container; and causing the control arms to move the first ends of the first half and second half of the retractable lid from the open position to the closed position, wherein movement of the first half and second half to the closed position comprises moving the first ends of the halves via pivoting about the fixed pivoting points from the open position in a generally upward direction relative to the opening and towards each other to meet in the closed position such that the halves are configured to cover the wick and to thereby extinguish the wick flame, wherein, when providing the halves in the open position, the halves of the retractable lid are spring loaded via tension being added to the tensions springs as the halves of the retractable lid are moved to the open position and kept open by the control arms, and wherein the tension assists in moving the first ends of the halves to the closed position when the control arms are caused to move the halves.

10. The method of claim 9, wherein the setting of the mechanical timer is performed before providing the first and second halves in the open position, wherein the setting comprises rotating a portion of the mechanical timer to set the predetermined timer period, and wherein the setting of the mechanical timer is configured to allow movement of the first and second halves such that the control arms are configured to keep the halves of the retractable lid in the open position.

11. The method of claim 9, wherein the method further comprises: triggering each of the plurality of sensors spaced around the opening in a chain reaction based on the detection by at least one of the plurality of sensors, and, as a result of the triggering, causing the control arms to move the retractable lid from the open position to the closed position.

12. The method of claim 9, wherein, in the closed position, the halves of the lid form a dome-like shape over the opening.

* * * * *